US012789067B1

(12) United States Patent
Joseph

(10) Patent No.: US 12,789,067 B1
(45) **Date of Patent: *Nov. 10, 2026**

(54) BASKETBALL LAUNCHING DEVICE WITH PLAYER HEIGHT COMPENSATION

(71) Applicant: Shoot-A-Way, Inc., Upper Sandusky, OH (US)

(72) Inventor: John G Joseph, Upper Sandusky, OH (US)

(73) Assignee: Shoot-A-Way, Inc., Upper Sandusky, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/181,937

(22) Filed: Apr. 17, 2025

Related U.S. Application Data

(63) Continuation of application No. 18/228,387, filed on Jul. 31, 2023, now Pat. No. 12,303,759.

(60) Provisional application No. 63/394,139, filed on Aug. 1, 2022.

(51) Int. Cl.

| | |
|---|---|
| ***A63B 69/00*** | (2006.01) |
| ***A63B 69/40*** | (2006.01) |
| ***A63B 71/00*** | (2006.01) |
| ***A63B 71/06*** | (2006.01) |

(52) U.S. Cl.
CPC ..... *A63B 69/0071* (2013.01); *A63B 69/408* (2013.01); *A63B 71/0622* (2013.01); *A63B 71/0009* (2013.01); *A63B 2071/0018* (2013.01); *A63B 2071/0675* (2013.01); *A63B 2214/00* (2020.08); *A63B 2225/093* (2013.01); *A63B 2225/096* (2013.01)

(58) Field of Classification Search
CPC ..... A63B 69/0071; A63B 69/408; A63B 71/0622; A63B 71/0009; A63B 2071/0018; A63B 2071/0675; A63B 2214/00; A63B 2225/093; A63B 2225/096

See application file for complete search history.

(56) References Cited

U.S. PATENT DOCUMENTS

| | | | |
|---|---|---|---|
| 4,714,248 | A | 12/1987 | Koss |
| 5,776,018 | A | 7/1998 | Simpson et al. |
| 6,659,893 | B1 | 12/2003 | Campbell et al. |
| 7,094,164 | B2 | 8/2006 | Marty et al. |
| 7,111,620 | B2 | 9/2006 | Johndreau et al. |
| 7,850,552 | B2 | 12/2010 | Marty et al. |
| 7,854,669 | B2 | 12/2010 | Marty et al. |
| 7,882,831 | B2 | 2/2011 | Alger |
| 8,012,046 | B2 | 9/2011 | Campbell et al. |

(Continued)

FOREIGN PATENT DOCUMENTS

CA 2757238 C * 6/2019 ..... A63B 71/06

*Primary Examiner* — Jeffrey S Vanderveen
(74) *Attorney, Agent, or Firm* — Standley Law Group LLP; Jeffrey S. Standley; Adam J. Smith

(57) ABSTRACT

A basketball launching device and related systems and methods which compensate for player height are provided. A controller queries a database of player information and associated launch characteristics with respective player information received from, or generated in response to data received from, a user interface. The controller commands a launching machine to launch basketballs in accordance with a returned one of the launch characteristics such that the basketballs are launched with forces and/or speeds which varies, at least in part, based on the launch characteristics.

20 Claims, 9 Drawing Sheets

(56) References Cited

U.S. PATENT DOCUMENTS

| | | | |
|---|---|---|---|
| 8,133,137 | B2 | 3/2012 | Grant et al. |
| 8,147,356 | B2 | 4/2012 | Campbell et al. |
| 8,408,982 | B2 | 4/2013 | Marty et al. |
| 8,409,024 | B2 | 4/2013 | Marty et al. |
| 8,617,008 | B2 | 12/2013 | Marty et al. |
| 8,622,832 | B2 | 1/2014 | Marty et al. |
| 8,852,030 | B2 | 10/2014 | Campbell et al. |
| 8,908,922 | B2 | 12/2014 | Marty et al. |
| 8,948,457 | B2 | 2/2015 | Marty et al. |
| 9,010,309 | B2 | 4/2015 | Lewis et al. |
| D739,488 | S | 9/2015 | Campbell et al. |
| 9,186,566 | B2 | 11/2015 | Boehner |
| 9,238,165 | B2 | 1/2016 | Marty et al. |
| 9,283,431 | B2 | 3/2016 | Marty et al. |
| 9,283,432 | B2 | 3/2016 | Marty et al. |
| 9,345,929 | B2 | 5/2016 | Marty et al. |
| 9,358,455 | B2 | 6/2016 | Marty et al. |
| 9,370,704 | B2 | 6/2016 | Marty et al. |
| 9,390,501 | B2 | 7/2016 | Marty et al. |
| 9,452,339 | B1 | 9/2016 | Shah et al. |
| 9,694,238 | B2 | 7/2017 | Marty et al. |
| 9,697,617 | B2 | 7/2017 | Marty et al. |
| 9,724,584 | B1 | 8/2017 | Campbell et al. |
| 9,734,405 | B2 | 8/2017 | Marty et al. |
| 9,808,696 | B2 | 11/2017 | Campbell et al. |
| 9,886,624 | B1 | 2/2018 | Marty et al. |
| 9,914,035 | B2 | 3/2018 | Campbell et al. |
| 9,975,026 | B2 | 5/2018 | Campbell et al. |
| 10,010,778 | B2 | 7/2018 | Marty et al. |
| 10,052,544 | B2 | 8/2018 | Gowan et al. |
| 10,092,793 | B1 | 10/2018 | Marty et al. |
| 10,252,128 | B2 | 4/2019 | Lewis et al. |
| 10,252,133 | B2 | 4/2019 | Campbell et al. |
| 10,315,090 | B2 | 6/2019 | Campbell et al. |
| 10,343,015 | B2 | 7/2019 | Marty et al. |
| 10,360,685 | B2 | 7/2019 | Marty et al. |
| 10,471,325 | B2 | 11/2019 | Marty et al. |
| 10,561,916 | B1 | 2/2020 | Campbell et al. |
| 10,596,436 | B1 | 3/2020 | Campbell et al. |
| 10,610,757 | B1 | 4/2020 | Marty |
| 10,762,642 | B2 | 9/2020 | Marty et al. |
| 10,806,986 | B2 | 10/2020 | Moore et al. |
| 10,956,723 | B2 | 3/2021 | Marty et al. |
| 10,994,182 | B1 | 5/2021 | Campbell et al. |
| 11,049,258 | B2 | 6/2021 | Marty et al. |
| 11,097,176 | B1 | 8/2021 | Campbell et al. |
| 11,123,605 | B1 | 9/2021 | Marty |
| 11,135,500 | B1 | 10/2021 | Campbell et al. |
| 11,247,109 | B1 | 2/2022 | Campbell et al. |
| 11,263,461 | B2 | 3/2022 | Marty et al. |
| 11,413,514 | B2 | 8/2022 | Marty et al. |
| 11,450,106 | B2 | 9/2022 | Marty et al. |
| 11,491,383 | B1 | 11/2022 | Campbell et al. |
| D972,675 | S | 12/2022 | Campbell et al. |
| 11,577,139 | B1 | 2/2023 | Campbell |
| 11,715,214 | B1 | 8/2023 | Marty et al. |
| 11,813,510 | B1 | 11/2023 | Campbell et al. |
| 11,836,929 | B2 | 12/2023 | Marty et al. |
| 11,890,521 | B1 | 2/2024 | Campbell et al. |
| 11,896,884 | B2 | 2/2024 | Marty et al. |
| 12,076,632 | B1 | 9/2024 | Joseph |
| 12,303,759 | B1 * | 5/2025 | Joseph ..... A63B 24/0087 |
| 2008/0200287 | A1 | 8/2008 | Marty et al. |
| 2014/0301601 | A1 | 10/2014 | Marty et al. |
| 2014/0305420 | A1 | 10/2014 | Deese |
| 2015/0352425 | A1 | 12/2015 | Lewis et al. |
| 2016/0193518 | A1 | 7/2016 | Baxter et al. |
| 2016/0193520 | A1 | 7/2016 | Hart |
| 2017/0072282 | A1 | 3/2017 | Lewis et al. |
| 2017/0095716 | A1 | 4/2017 | Lewis et al. |
| 2017/0340943 | A1 | 11/2017 | Pierotti |
| 2022/0415048 | A1 | 12/2022 | Marty et al. |
| 2024/0071140 | A1 | 2/2024 | Marty et al. |
| 2024/0087137 | A1 | 3/2024 | Marty et al. |

* cited by examiner

BASKETBALL LAUNCHING DEVICE WITH PLAYER HEIGHT COMPENSATION

CROSS-REFERENCE TO RELATED APPLICATIONS

This application is a continuation of U.S. application Ser. No. 18/228,387 filed Jul. 31, 2023, which claims the benefit of U.S. provisional application Ser. No. 63/394,139 filed Aug. 1, 2022, the disclosures of each of the foregoing are hereby incorporated by reference as if fully restated herein.

TECHNICAL FIELD

Exemplary embodiments relate generally to basketball launching devices and related systems and methods that compensates for player height, such as by automatically adjusting launch characteristics (e.g., force and/or speed).

BACKGROUND AND SUMMARY OF THE INVENTION

A variety of basketball launching devices are known. Generally speaking, these devices are configured to launch basketballs to user selected locations about a basketball court for a player to catch and shoot towards a basketball goal. These devices permit a player to increase shot repetition to improve performance, among other features. Basketball is becoming increasingly popular with a wide variety of individuals, and therefore basketball players vary in age, gender, height, and ability, to name some non-limiting examples. For ergonomics and/or to simulate game conditions, it is generally desirable to receive basketball passes at approximately chest height. However, chest height varies for individuals of different age, gender, height, and ability, to name some non-limiting examples. Therefore, what is needed is a basketball launching device which compensates for player height.

Basketball launching devices, and related systems and methods, are provided which compensate for player height. A user interface may permit a user, which may be the player or a third party (e.g., a coach, parent, etc.), to input user height information. Height information may include overall height and/or approximate chest height, for example without limitation. The height information may comprise height measurements (e.g., overall or chest height), and/or generalized information such as player age, gender, ability, combinations thereof, or the like from which average or approximate height information may be determined. For example, without limitation, a user or player may not know their exact height at the time and thus may input an age, gender, or the like an approximate or estimated height may be retrieved and utilized as a default. The height information may, alternatively or additionally, be stored in association with player information (e.g., login information) and may be automatically retrieved and utilized when the player logs into the device or otherwise provides identifying information. Where height information is entered, such as for a new user or to update information for an existing user, it may be electronically stored in association with a player profile so that it may be automatically retrieved during subsequent logins.

A basketball launching device may be configured for automatic adjustment to account for the player's height, such as by way of commands issued by a controller to a launching mechanism. For example, without limitation, a speed at which motors turn wheels used to launch the basketballs to various pass receipt locations may be increased for relatively taller players so that the basketball is received at approximately chest height at the designated pass receipt location. As another example, without limitation, a force at which a launching arm is moved to launch the basketballs to various pass receipt locations may be decreased for relatively shorter players so that the basketball is received at approximately chest height at the designated pass receipt location. The adjustment may be further refined by user preferences, to simulate poor passing (e.g., too high or too low), and/or other feedback.

The disclosed devices, systems, and methods may permit distribution of basketballs at appropriate heights for various players. For example, very young players and children may be relatively short, while adult players may be relatively tall. Even within various age groups, height may vary significantly. By way of one non-limiting example, the disclosed devices, systems may permit distribution at an appropriate height to wheelchair bound individuals or persons of various physical handicaps or abilities. In this manner, height may be automatically compensated for such that basketballs are consistently launched to approximately chest height for the individual, despite variations in height among individuals.

Further features and advantages of the systems and methods disclosed herein, as well as the structure and operation of various aspects of the present disclosure, are described in detail below with reference to the accompanying figures.

BRIEF DESCRIPTION OF THE DRAWINGS

In addition to the features mentioned above, other aspects of the present invention will be readily apparent from the following descriptions of the drawings and exemplary embodiments, wherein like reference numerals across the several views refer to identical or equivalent features, and wherein.

DETAILED DESCRIPTION OF EXEMPLARY EMBODIMENT(S)

Various embodiments of the present invention will now be described in detail with reference to the accompanying drawings. In the following description, specific details such as detailed configuration and components are merely provided to assist the overall understanding of these embodiments of the present invention. Therefore, it should be apparent to those skilled in the art that various changes and modifications of the embodiments described herein can be made without departing from the scope and spirit of the present invention. In addition, descriptions of well-known functions and constructions are omitted for clarity and conciseness.

Embodiments of the invention are described herein with reference to illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

Figure 1:
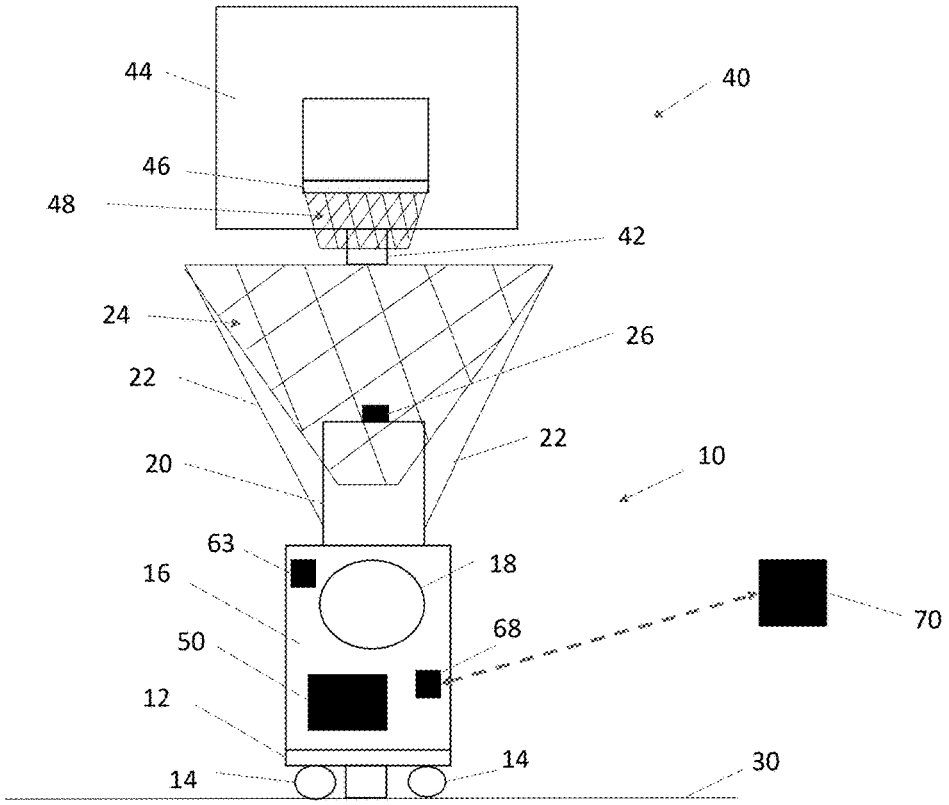
FIG. 1 is front view of an exemplary basketball launching device at an exemplary basketball playing area.
Figure 2:
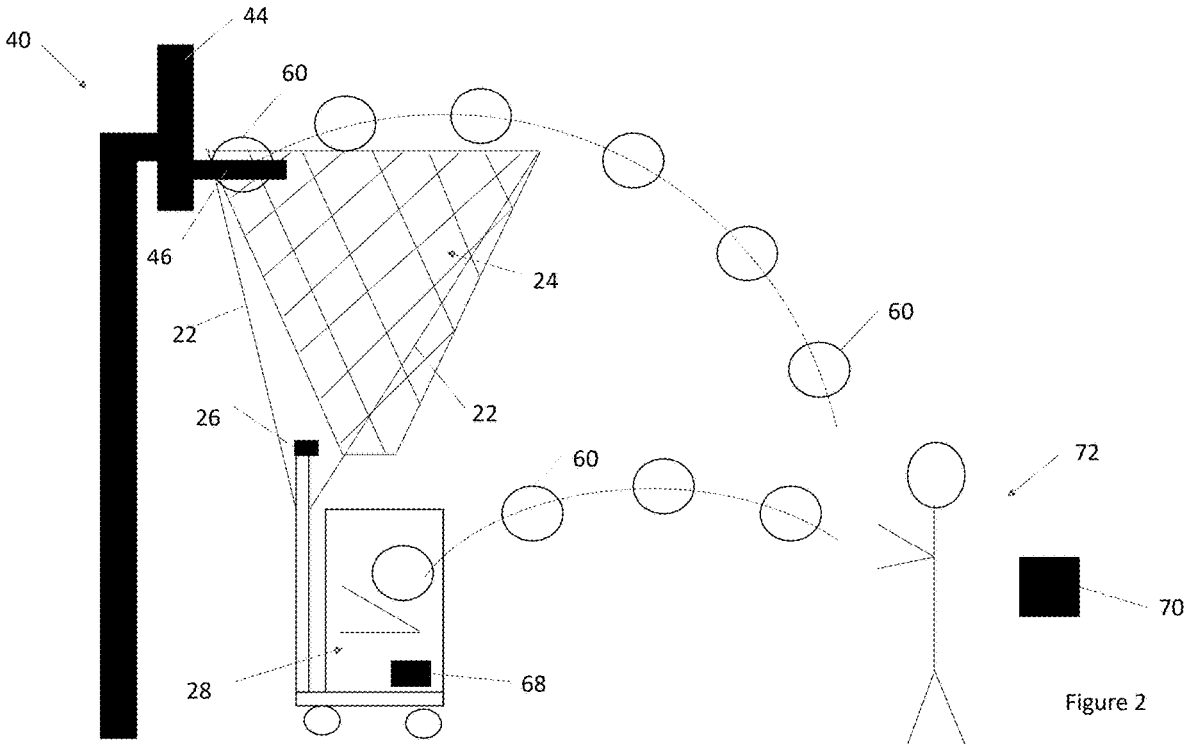
FIG. 2 is a side view of the basketball launching device of FIG. 1 further illustrating exemplary basketball passing and shooting trajectories while in exemplary use.

FIG. 1 and FIG. 2 illustrate an exemplary basketball launching device 10. The basketball launching device 10 may comprise a support structure 12. The support structure 12 may comprise a frame, platform, rigid members, combinations thereof, or the like. A number of wheels 14 may be mounted to the support structure 12 which permit movement of the basketball launching device 10 around a playing area 30.

A housing 16 may be mounted to the support structure 12. The housing 16, in exemplary embodiments, may be mounted to the support structure 12 in a rotatable manner. One or more apertures 18 may be located in the housing 16. At least a first one of the apertures 18 may be sized to permit basketballs 60 to be ejected therethrough to various pass receipt locations at the playing area 30. The first one of the apertures 18 may be located on a front of the housing 16, though any location may be utilized. A second one of the apertures 18 may be located on an upper portion of the housing 16 and may be sized to permit the basketballs to enter the housing 16 through the second one of the apertures 18. In other exemplary embodiments, the housing 16 is not required or is provided outside the travel path of the basketball.

The support structure 12 may comprise a frame 20, at least a portion of which may extend vertically. At least a portion of the frame 20 may be collapsible, though such is not required. The frame 20 may comprise one or more support members 22. At least some of said support members 22 may be adjustable in length. In exemplary embodiments, at least some of the support members 22 may comprise telescoping poles. In exemplary embodiments, four support members 22 may extend upwardly and outwardly from the support structure 12 in a splayed fashion, though any number and configuration of support members 22 may be utilized. The support member 22 may, in exemplary embodiments, be selectively collapsible.

A net 24 may be attached to one or more of the support members 22. Openings in the net 24 may be sized to prevent the basketballs 60 from passing therethrough. The net 24 may be configured to create a funnel shape when mounted to said support members 22 such that basketballs 60 gathered in the net 24 are directed towards the housing 16 where they may be received through one or more openings, such as but not limited to, the second one of the apertures 18. However, any size, shape, and type of net 24 may be utilized. Alternatively, or in addition, one or more guide tracks may extend between the bottom of the net 24 and the housing 16.

The basketball launching device 10 may be placed in proximity to a basketball goal 40 by a user, such as directly below a rim 46 of the goal 40. The basketball goal 40 may be regulation type, height, size and configuration, though such is not required. The basketball goal 40 may comprise a post 42 which extends to the playing area 30, a backboard 44, the rim 46, and a net 48, for example without limitation. For example, without limitation, the rim 46 may be positioned 10 feet above the playing area 30. The basketball goal 40 may be separate from the basketball launching device 10 in exemplary embodiments.

Some or all of the frame 20 may be adjustable. For example, without limitation, the frame 20 may comprise one or more mechanisms for collapsing the support members 22, the net 24, and/or the frame 20. In this way, the basketball launching device 10 may be selectively reduced in size. In exemplary embodiments, the basketball launching device 10 may be sufficiently reduced in size so as to fit through a standard size doorway, though such is not required. As another example, without limitation, the frame 20 may comprise one or more mechanisms for expanding the support members 22, the net 24, and/or the frame 20. In this way, the basketball launching device 10 may be selectively increased in size. In exemplary embodiments, the basketball launching device 10 may be positioned and sufficiently increased in size such that one or more upper edges of the net 24 extend above the rim 46 of the basketball goal 40 when so positioned. When expanded, the net 24 may create a sufficiently sized top opening to accommodate most, or all, of a user's made shots as well as at least some, or all, of the user's missed shots, which are gathered by the net 24 and returned to the housing 16.

In still other exemplary embodiments, adjustment of the net 24 may be achieved by adjustment of the support members 22, with or without adjustment of the frame 20. FIG. 1 illustrates an exemplary configuration of the basketball launching device 10 with the net 24 positioned below the rim 46 and FIG. 2 illustrates an exemplary configuration of the basketball launching device 10 with the net 24 positioned above the rim 46 of the basketball goal 40. Any height of the net 24 in a collapsed and/or expanded position may be utilized.

The basketball launching device 10 may comprise one or more detectors 26. The detector(s) 26 may comprise, for example without limitation, photo eyes, microphones, limit switches, bimorphs, accelerometers, mechanical flappers, proximity sensors, cameras, image recognition software (e.g., machine vision), ultrasonic transmitters/receivers, combinations thereof, or the like. Any type or kind of detector 26 or combinations of detectors 26 may be utilized. The detector(s) 26 may be configured to sense movement of a basketball at a location indicating a made basketball shot. For example, without limitation, the detector(s) 26 may be positioned adjacent to (e.g., below) the rim 46 of the basketball goal 40 and/or in view of an area below or adjacent to the rim 46, and detection of a presence of a basketball within the sensed area may indicate a made goal. Similarly, non-detection of the presence of a basketball within the sensed area for a predetermined amount of time after a basketball pass and/or before a next pass is launched may indicate a missed shot.

The detector(s) 26 may be mounted to the frame 20, provided separately and in wired or wireless communication with other components of the basketball launching machine 10, and/or provide in any location. Any number, type, and/or location of detector(s) 26 may be utilized.

The basketball launching device 10 may comprise an interface 50. The interface 50 may be configured to receive user input and/or display information. The interface 50 may comprise one or more physically depressible buttons, electronic icons capable of direct or indirect selection, one or more electronic displays, one or more touch screens, combinations thereof, or the like. The interface 50 may be connected to the frame 20. Alternatively, or additionally, the interface 50 may be mounted to the housing 16 or other component of the basketball launching machine 10. Any size, shape, or location of the interface 50 may be utilized.

Alternatively, or additionally, the interface 50 may be provided at one or more personal electronic devices 70 such as, but not limited to, a smartphone, a tablet, a personal computer, some combination thereof, or the like. Such personal electronic devices 70 may be physically separate from the basketball launching machine 10 or physically integrated therewith. For example, without limitation, the personal electronic devices 70 may be permanently, semi-permanently, or removeable mounted to one or more components of the basketball launching machine 10. In other exemplary embodiments, the personal electronic devices 70 may be configured for selective and/or temporary mounting to the frame 20, housing 16, or other component of the basketball launching machine 10 such as, but not limited to, by way of a holder or mounting device.

The personal electronic devices 70 may be in wired or wireless communication with one or more components of the basketball launching device 10, such as by way of one or more networks (e.g., internet, intranet, cellular networks, near field communication devices, combinations thereof, or the like).

The basketball launching device 10 may comprise a launching mechanism 28. The launching mechanism 28 may be mounted to the frame 20. The launching mechanism 28 may be located at least partially within the housing 16, though such is not necessarily required.

The launching mechanism 28 may be configured to launch one or more basketballs 60 to one or more pass receipt locations at the playing area 30 for a player 72 to catch and shoot towards the basketball goal 40. For example, without limitation, the launching device 28 may comprise a catapult arm, lever, thrower, wheeled or multi-wheeled device, piston, air powered ejector, combinations thereof, or the like. Any kind or type of launching device 28 may be utilized. The launcher 28 may be mounted to the housing 16 and/or the support structure 12 in a rotatable manner, though such is not required.

The launching mechanism 28 may comprise one or more devices for adjusting launch force and/or speed, and thus corresponding flight distance of the basketball 60. For example, without limitation, rotational wheel 80 and/or motor 84 speed may be increased or decreased (e.g., by electronic command, power supplied, combinations thereof, or the like), force exerted by a catapult arm may be increased or decreased (e.g., by spring tension forces, counter weight, combinations thereof, or the like), air pressure used to launch the basketballs 60 may be increased or decreased (e.g., as applied directly to the basketball and/or related component such as a piston, catapult arm, etc.), hydraulic piston pressure may be increased or decreased, spring length increased or decreased, combinations thereof, or the like. Various motors, mechanical linkages, actuators, springs, elastic bands, gears, levers, combinations thereof, or the like may be utilized, engaged, disengaged, and/or adjusted to make such adjustments. For example, without limitation, gearing may be adjusted, levers or the like may be engaged/disengaged, combinations thereof, or the like to adjust mechanical forces transmitted.

The launching mechanism 28 may be placed in electronic communication with a controller 68. The controller 68 may be configured to electronically command operation of the launching mechanism 28. For example, timing of launches, number of launches, movement of the launching mechanism 28, launching speed, force, and/or distance, launch direction, combinations thereof, or the like.

Figure 3A:
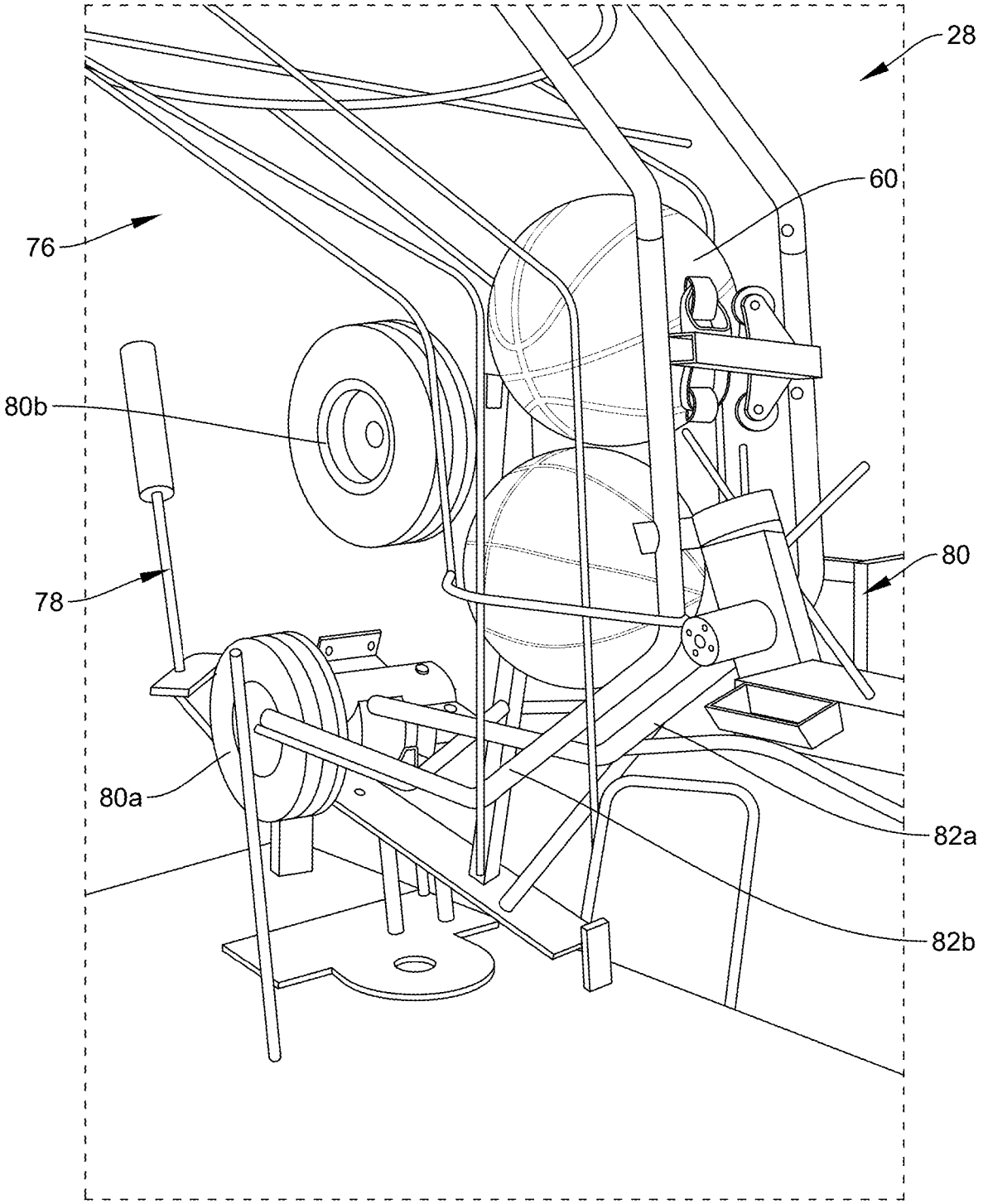
FIG. 3A is a rear perspective view of an exemplary basketball launching mechanism for the basketball launching device of FIG. 1.
Figure 3B:
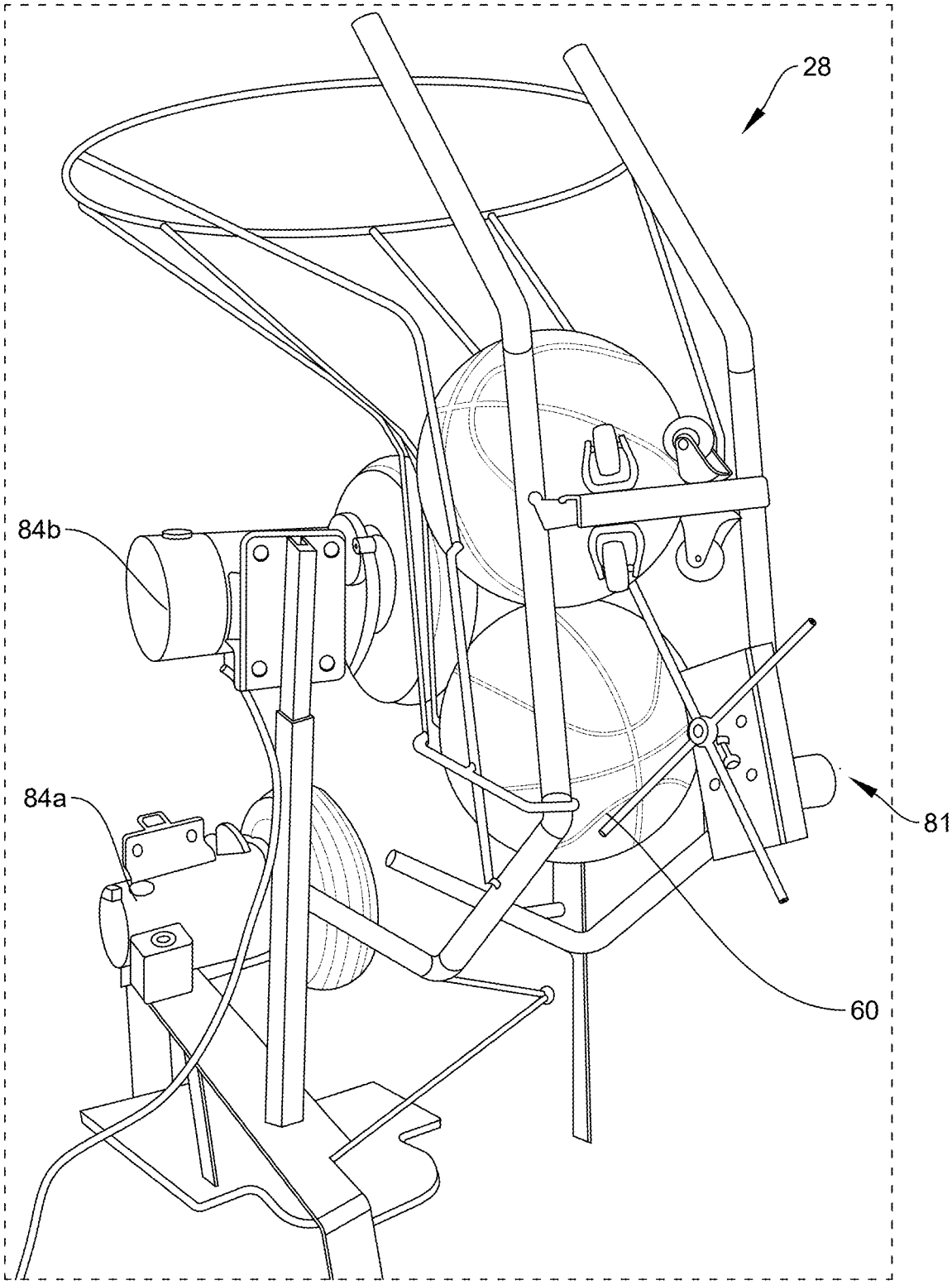
FIG. 3B is another rear perspective view of the basketball launching mechanism of FIG. 3A.

FIG. 3A and FIG. 3B illustrate an exemplary launching mechanism 28, without limitation. The launching mechanism 28 may comprise, or be associated with and/or placed adjacent to, a basketball guide 76. The launching mechanism 28 may comprise, or be associated with and/or placed adjacent to, a basketball metering device 81. The basketball guide 76 may comprise a series of members 82 arranged to gather, contain, propel and/or guide basketballs 60 to the metering device 81, and ultimately, a propulsion device 78. The members 82 may act as rails for carrying and/or directing the basketballs, such as under gravitational forces. The guide 76 may be configured to permit the basketballs 60 to be moved by gravitational forces along the guide 76. The guide 76 may comprise one or more cage or tubular structures to limit and/or direct basketball travel. At least some of the members 82, such as 82*a* and 82*b*, may be arranged alongside one another and for guiding said basketballs 60 to and/or through said metering device 81, such as but not limited to, by gravitational forces such that said basketballs 60 are biased towards propulsion along said members 82*a* and 82*b*. At least a portion of said members 82*a* and 82*b* may form a ramped surface configured to propel said basketballs 60 towards said propulsion device 78 when released by said metering device 81. One more such member 82 may extend to a base, frame, housing, or other structure for securing the machine 10 or other components.

The propulsion device 78 may comprise one or more wheels 80. In exemplary embodiments, multiple wheels 80 are provided, each of which are attached to a respective motor 84. However, any number of wheels 80 and/or motors 84 may be utilized such that some or all of the wheels 80 are attached to one of the motors 84. The motor(s) 84 may be configured to spin the wheel(s) 80 to launch the basketballs 60 released by the metering device 81 to various locations at a basketball playing surface. In exemplary embodiments, a first wheel 80*a* may be installed adjacent to a distal portion of one or both of the members 82*a* and 82*b* and a second wheel 80*b* may be installed vertically spaced apart from the first wheel 80*a*. In exemplary embodiments, the first and second wheels 80 may be spaced at a distance sufficient to accommodate the basketballs 60. The first and second wheels 80 may be horizontally offset so as to facilitate an upward arc to a flight path of the launched basketballs 60, though such is not required. Each of the wheels 80 may be associated with a motor 84 in exemplary embodiments. The motors 84 may be configured to spin at up to 7800 rpm in exemplary embodiments without limitation. However, rotational speed of the motors 84 may be electronically limited, such as to 600 rpm and/or a range for example without limitation. The rotational speed of the motors 84 may be altered to adjust ejection speed, distance, spin, force, and/or velocity of the basketballs 60, such as by way of electronic command from the controller 68.

The propulsion device 78 may be configured for direct or indirect rotational or pivoting movement to launch said basketballs 60 to a variety of locations, such as but not limited to, about a three-point arc of the basketball playing area. For example, without limitation, some or all of the device 10 may be configured for rotational or pivoting movement.

Figure 4A:
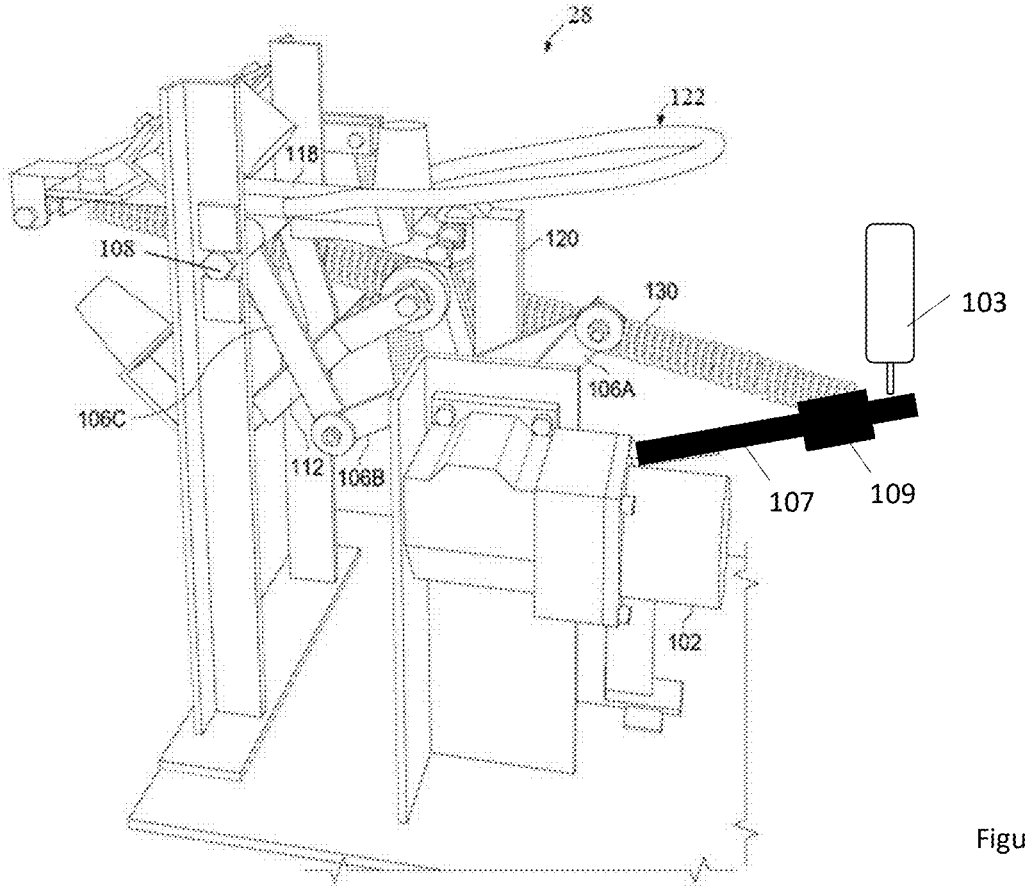
FIG. 4A is a right-side perspective view of another exemplary basketball launching mechanism for the basketball launching device of FIG. 1 in a first position.
Figure 4B:
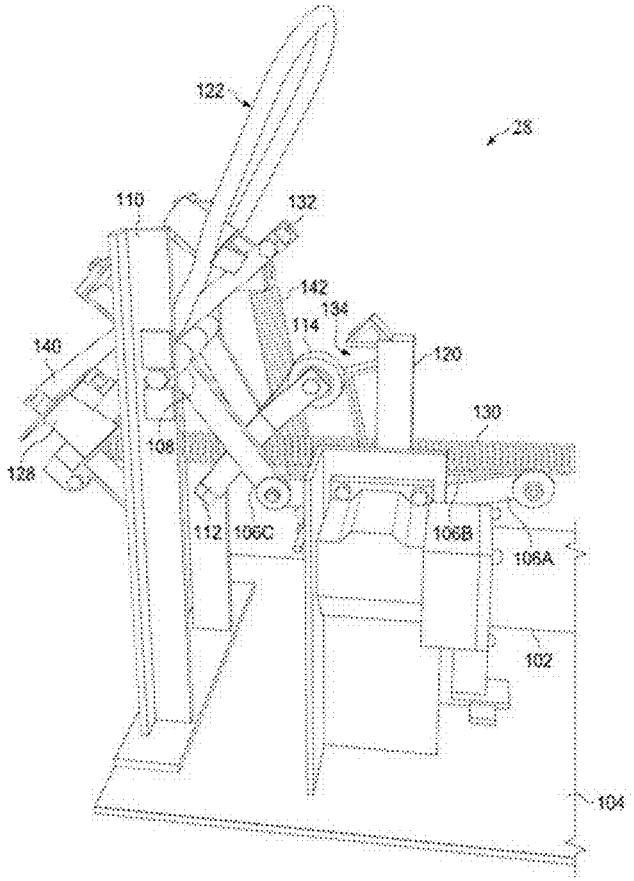
FIG. 4B is right-side perspective view of the basketball launching mechanism of FIG. 4A in a second position.

Another exemplary launching mechanism 28 is shown in FIG. 4A and FIG. 4B and may comprise a catapult arm 118 which is mounted to an axel 108. The axel 108 may be supported above a base 104 by one or more supports 110. A spring 130 may be connected to a first portion of the catapult arm 118 located at a first side of the axel 108.

A basketball holder 122 may be provided at a second portion of the catapult arm 118 located at a second side of the axel 108. A ram 112 may be suspended below the axel 108, such as by way of one or more linkages 106. Connection of the ram 112 to and below the axel 108 may permit swinging movement of the ram 112 between forcing the catapult arm 118 into a first position (e.g., FIG. 4A) where the spring 130 is extended and a portion 132 of catapult arm 118 is secured within a recessed area 134 of a holder 120 which is preferably elevated from the base 104, and a second position (e.g., FIG. 4B) where the ram 112 contacts the holder 120 (e.g., by way of an attached wheel 114 along a ramped forward surface, though such is not required) to release the catapult arm 118 from the recessed area 134 for rotational movement about the axel 108 by way of the spring 130 forces.

Movement of the ram 112 may be caused by a motor 102, which may be configured for continuous rotational movement, and/or alternating movement (e.g., actuator). The motor 102 may be in electronic communication with, and/or controlled by, the controller 68. One or more linkages 106 may connect the motor 102 to the ram 112 and/or axel 108. The linkages 106 may comprise arms which are movably interconnected, gears and chains, levers, cams, linkages, belts, combinations thereof, or the like. For example, without limitation, a three-bar linkage 106A-106C may be employed to essentially translate continuous rotational movement of the motor 102 into a swinging motion of the ram 112. As another example, without limitation, the motor 102 may comprise a linear actuator directly or indirectly connected to the ram 112 to cause the swinging movement.

Rotational movement of the catapult arm 118 may be limited by a stop bar 140 which is preferably laterally disposed on the first portion of the catapult arm 118 to engage stoppers 128, preferably located on the supports 110. One or more additional springs 142 may be provided for stabilization.

In exemplary embodiments, without limitation, the spring 130 is connected to a motor 103 (e.g., actuator), which may be mounted to the base 104 or another component. The motor 103 may be separate from the motor 102 from the ram 112 or a common motor may be utilized. The spring 130 may be directedly connected to the motor 103, or connected by one or more intermediary elements, such as but not limited to a movable lever 107, slider 109 along the lever 107 or another member, linkage, combinations thereof, or the like. The motor 103 may be in electronic communication with and/or controlled by the controller 68. In this way, a length of the spring 130 may be adjusted when the catapult arm 118 is in the first position, thereby adjusting tension forces in the spring 130. This may, in turn, adjust the launching forces and/or speed of basketballs. Stated another way, a maximum length, and thus force exerted by, the spring 130 may be controlled. In exemplary embodiments, without limitation, the lever 107 is configured for rotational movement relative to the base 104 to adjust the maximum length of the spring 130 when the motor 102 moves the catapult arm 118 into the first position. The motor 103 (and/or motor 102) may be controlled by the controller 68 such as to control basketball launching speed, force, and/or other characteristics.

Other examples of such launching devices 28 include, without limitation, the disclosures of U.S. Pat. No. 5,776,018 to Simpson et al. issued Jul. 7, 1998 ("Simpson"), which are hereby incorporated by reference as if fully restated herein. Still other examples of launching devices 28 include, without limitation, U.S. Pat. No. 6,224,503 dated May 1, 2001, which is hereby incorporated by reference as if fully restated herein. Still other examples of launching devices 28 and/or other certain components of the devices 10 may include, without limitation, those provided by THE GUN® family of devices (e.g., 6000, 7000, 8000, 10k, and 12k) available from Shoot-A-Way of Upper Sandusky, Ohio (https://www.shootaway.com/), and the DR. DISH family of devices (e.g., CT, HOME, REBEL, PRO, ALL-STAR, REBEL+, and ALL-STAR+) available from Airborne Athletics of Minneapolis, Minnesota (https://www.drdishbasketball.com/). Any type or kind of launching device 28 may be utilized. Such devices 28 may be in electronic communication with, and operable controlled by, the controller 68 such as to control basketball launching speed, force, and/or other characteristics.

Figure 5:
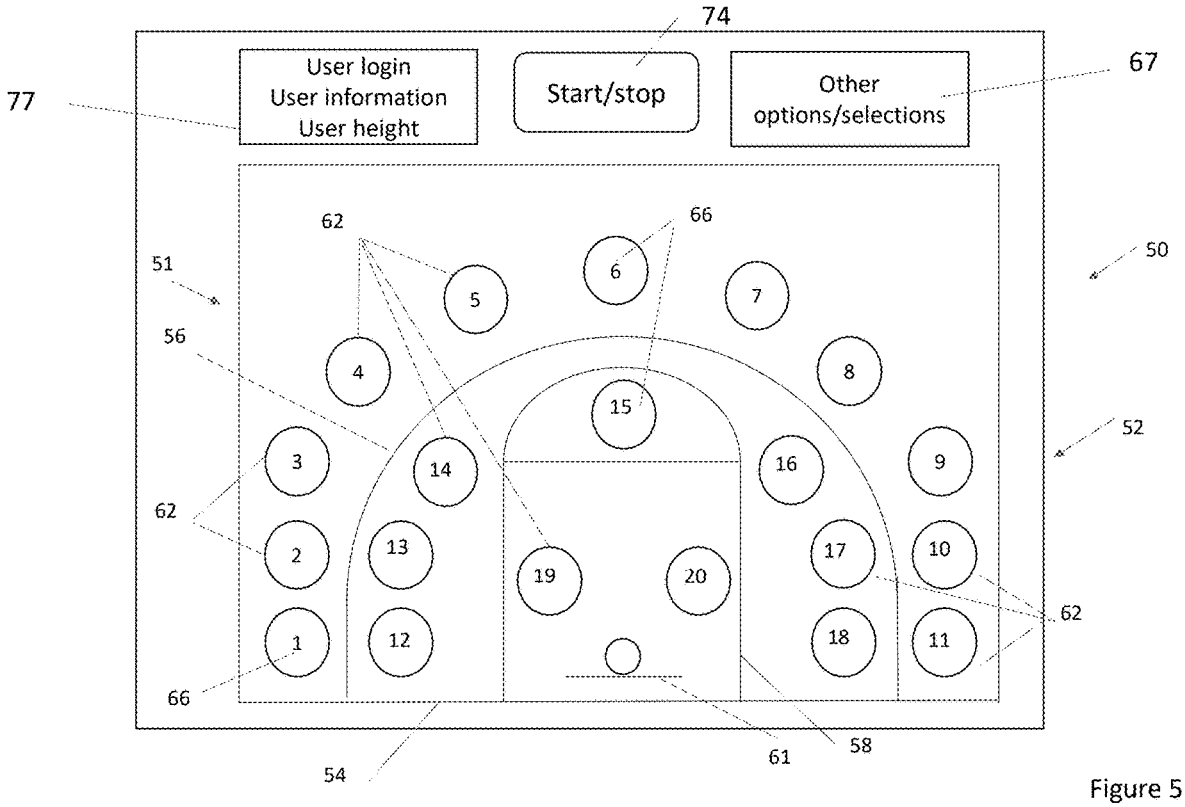
FIG. 5 is a plan view of an exemplary user interface for the basketball launching device of FIG. 1.

Referring additionally to FIG. 5, the interface 50 may be placed in electronic communication with the controller 68. The controller 68 may be located at or within the housing 16, though the controller 68 may be placed elsewhere, including but not limited to at a remote location such as a server and/or personal electronic device 70. The controller 68 may comprise one or more electronic storage devices with executable software instructions and one or more processors. Alternatively, or in addition, the controller 68 may be part of one or more other components of the basketball launching device 10 including but not limited to, the interface 50 and/or the personal electronic devices 70.

The interface 50 may comprise a rendering, illustration, or other visual depiction 52 of elements of an exemplary playing area 30, such as but not limited to a regulation basketball court, or part of such a court. The visual depiction 52 may comprise, for example without limitation, depictions of a baseline, a key, a three-point arc, a basketball goal, combinations thereof, or the like. Any size, shape, arrangement, type, or kind of such basketball playing area elements or regulation or non-regulation type playing areas may be provided as part of the visual depiction 52 on the interface 50.

The location selection display 51 may comprise a number of selectable areas 62. The selectable areas 62 may be located at various positions on the visual depiction 52 to correlate with pass receipt positions on the playing area 30. The selectable areas 62 may be selected by the user to create custom shooting arrangements. The selectable areas 62, in exemplary embodiments, may be visually depicted as indicia, such as but not limited to a circle though any size, shape, color, type, or the like of such selectable areas 62 may be utilized.

In exemplary embodiments, the interface 50 may comprise a touch screen. In such embodiments, the visual depiction 52 may be electronically generated electronic icons at the touch screen, such as part of one or more graphical user interfaces (GUIs). The selectable areas 62, in such embodiments, may already be visible on the interface 50, such as in the form of indicia or icons, and may change when selected. In other such embodiments, the selectable area 62, such as in the form of indicia or icons, may not be visible and may become visible when the corresponding area of the interface 50 is selected. Such selection may be performed by direct, individual, physical contact, though such is not required. The touch screen may comprise a resistive, capacitive, or other type of touch screen. Some or all of the selectable areas 62 may be physically and/or electrically separated from one another or may be part of an undivided touch screen, display, panel, or the like. In other exemplary embodiments, the selectable areas 62 may be visually indicated upon selection at the interface 50.

In other exemplary embodiments, the interface 50 may comprise an electronic display. In such embodiments, the visual depiction 52 may be electronically generated on the electronic display. The selectable areas 62, in such embodiments, may already be visible on the interface 50, such as in the form of indicia or icons, and may change when selected. Such selection may be performed by one or more selection devices 64. Such selection devices 64 may permit interaction with the images displayed on the electronic display. For example, without limitation, such selection devices 64 may comprise a keypad, mouse, buttons, arrows, some combination thereof, or the like. The electronic display may comprise an LCD, cathode ray, OLED, plasma, or other type of electronic display. In other exemplary embodiments, the selectable areas 62 may be visually indicated upon selection at the interface 50.

In still other exemplary embodiments, the interface 50 may comprise a static panel. In such embodiments, the visual depiction 52 may be painted, printed, integrally formed, or otherwise provided on the interface 50 in a permanent or semi-permanent fashion. The selectable areas 62, in such embodiments, may comprise buttons, which may be physically depressible by way of non-limiting example. The selectable areas 62 may comprise illumination devices or the like which are configured to indicate whether the selectable areas 62 have been selected by a user. Such selection may be performed by direct, individual, physical contact, though such is not required.

Once selected, the selected ones of the selectable areas 62 may be changed, such as by illumination, highlighting, color changes, appearance, disappearance, shape change, number or other indication change, filled in, visually appear, combinations thereof, or the like.

The selectable areas 62 may be provided at various locations on the visual depiction 52. The selectable areas 62 may be circular in shape, though any size and shape selectable areas 62 may be utilized. The selectable areas 62 may be located at spaced angular positions along the visual depiction 52. For example, without limitation, a number of selectable areas 62 may be positioned on or along the visual depiction of the three-point arc 56. In exemplary embodiments, some of the selectable areas 62 may be located inside the three-point arc 56 and other selectable areas 62 may be located outside of the three-point arc 56, though such is not required. Alternatively, or in addition, some or all of the selectable areas 62 may be located within or around the visual depiction of the key 58. The selectable areas 62 may, alternatively or additionally, be provided in visual correlation to a visual depiction of a baseline 54 and/or basketball goal 61. Any size, shape, number, or arrangement of selectable areas 62 may be utilized.

Each of the selectable areas 62 may comprise one or more markers 66. The markers 66 may comprise numbers, letter, symbols, some combination thereof or the like. The markers 66 may provide nomenclature for the selectable areas 62 as well as the corresponding shooting positions on the playing area. The interface 50 may be configured to monitor for, and/or receive, a user selection of one or more of the selectable areas 62 to create a custom basketball practice arrangement. The selectable areas 62 may be individually selected by physical touch in a direct or indirect manner. The selectable areas 62 may form input locations for receiving user input.

Alternative or in addition to the embodiments described herein, a number of predetermined sets of selectable areas 62 may be preprogrammed to define pre-made practice arrangements. Such pre-made practice arrangements may be made available by way of certain ones of said selectable areas 62. In such embodiments, the interface 50 may be configured to permit the user to select one or more such predetermined programs as an alternative to, or in addition to, creating a custom practice arrangement.

The selectable areas 62 may be arranged on the visual depiction 52 to visually correspond with pass receipt locations at the playing area. In this way, the player knows where to stand to receive passes from the basketball launching machine 10 and the player is able to select particular areas to focus on, such as areas of weakness. The selectable area 62 may be provided on a 1:1 basis with such pass receipt locations, though any ratio may be utilized.

The interface 50 may comprise one or more areas 67 for selecting additional options such as, but not limited to, a time delay between passes, a number of basketballs per location, a shots made challenge, a shots made in a row challenge, one or more pre-programmed drills, off dribble information, serial or non-serial order of selection, combinations thereof, and the like. In exemplary embodiments, the separate area(s) 67 may not be required and such options may be selected at the area with the visual depiction 52. The areas 67 may be part of the interface 50, or be separate therefrom. The areas 67, for example without limitation, may comprise further selectable areas of a touch screen, icons on an electronic display, dedicated button(s), combinations thereof, of the like.

The user interface 50, in exemplary embodiments without limitation, may be configured to accept revision of the user selection until a start/stop option 74 is actuated. Such revision may be made, for example without limitation, by actuating one of the selected ones of the selectable locations 62 an additional time, which may de-select the previously selected ones of the selectable locations 62.

The interface 50 may be configured to accept player 72 information, such as at a player information area 77. The player information area 77 may be configured to accept registration information for a new player 72 and/or login or other identifying information for an already registered player 72. Login information may include, for example without limitation, user name, password, authentication information (biometric or otherwise), player name, player ID (e.g., number, code, etc.), combinations thereof, or the like. Registration information may include, for example without limitation, player name, user name, password, authentication information, team information, and/or height information. Height information may include, for example without limitation, overall standing height, chest height, age, gender, and/or ability information. The player information area 77 may be further configured to accept user preference information including, but not limited to, adjustments to launch speed and/or force. Multiple players, such as a team or other group, may be logged in at the player information area 77, separately or together.

The controller 68 may be configured to receive electronic signals from the interface 50, such as player information at the player information area 77. The controller 68 may be configured to authenticate or verify user login, create new user profiles based on registration information, and/or update user profiles based on preferences or revisions to user information, by way of non-limiting example.

Figure 6A:
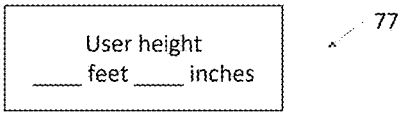
FIG. 6A is a detailed plan view of a portion of the user interface of FIG. 5.
Figure 6B:
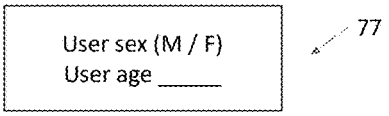
FIG. 6B is a detailed plan view of another exemplary embodiment of the portion of the user interface of FIG. 5.
Figure 6C:
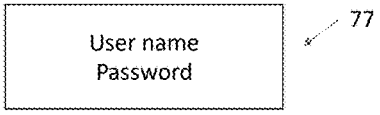
FIG. 6C is a detailed plan view of another exemplary embodiment of the portion of the user interface of FIG. 5.

As illustrated with particular regard to FIG. 6A, the player information area 77 may comprise prompts to manually input user height (e.g., feet and inches). As illustrated with particular regard to FIG. 6B, the player information area 77 may comprise prompts to enter user information (e.g., sex, age) and an average height may be retrieved, such as by way of one or more databases and/or lookup tables at, or in electronic communication with, the controller 68. As illustrated with particular regard to FIG. 6C, the player information area 77 may comprise prompts to enter login information and height information associated with the login information may be retrieved, such as by way of one or more databases and/or lookup tables at, or in electronic communication with, the controller 68. Other player identifying information may be utilized such as name, team information, player code, team code, combinations thereof, or the like. The selections at the interface 50 may be made by way of any selection/interface technique (e.g., numerical entry, arrows up/down, voice input, selection from menu, etc.)

The controller 68 may be configured to receive electronic signals from the interface 50, such as selections of the selectable areas 62 to form a custom practice arrangement. The controller 68 may be configured to program the launcher 28 to pass basketballs 60 to each of the pass receipt locations at the playing area 30 corresponding to each of selectable areas 62 selected by the user at the interface 50 to perform the custom practice arrangement in exemplary embodiments, without limitation. The controller 68 may be configured to, alternatively or additionally, receive input from the interface 50 including user selection of the selection devices 64, area 67, user preferences, other options, some combination thereof, or the like and program the launcher 28 and/or display such user selections at the interface 50 in accordance with the received input.

The controller 68 may be configured to adjust the launching mechanism 28, such as by way of electronic command(s) issued to one or more components thereof, based at least some of the player information received at the player information area 77, such as but not necessarily limited to, based on player height information received at the player information area 77 or electronically retrieved based on player information provided at the player information area 77. For example, without limitation, the controller 68 may control the motor 103 to adjust the maximum length of the spring 130 based on the data from the player information area 77. As another example, without limitation, the controller 68 may control the motor(s) 84*a, b* based on the data from the player information area 77. The adjustments may be made by reference to one or more lookup tables with established parameters for various heights, where parameters are set to result in relatively higher speed/force for relatively taller players and vice-versa. In exemplary embodiments, the lookup tables may provide a positive correlation between launching speed and/or force with player height.

Alternatively, or additionally, the controller 68 may be configured to adjust the launching mechanism 28 based on other selections made at the interface 50, such as to simulate various basketball pass types (e.g., poor passes, too high or too low), user preferences, to reach various parts of the playing area (e.g., locations 62 selected further from, or close to, the goal 61 and/or the launcher), to facilitate various practice drills (e.g., off-dribble shooting), combinations thereof, or the like. Lookup tables may be provided for the same which provide launch parameters or adjustments to other launch parameters to accommodate the same. For example, without limitation, a first lookup may be made based on player height which returns a launch speed or force. A second lookup may be made based on other selections made at the interface 50 which is used to modify the launch speed or force up or down a returned amount.

Figure 7:
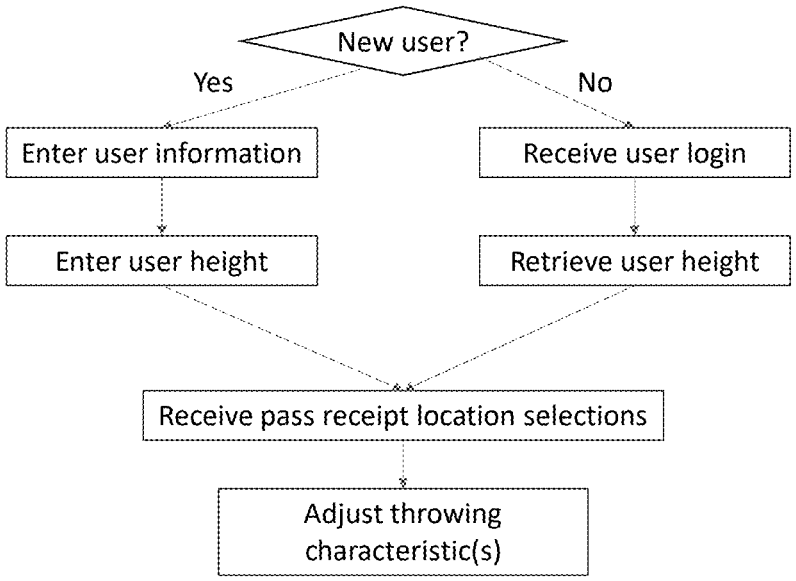
FIG. 7 is a flow chart with exemplary logic for operating the basketball launching device of FIG. 1.

Referring additionally to FIG. 7, a user may register or login at the interface 50. Logging in may require some form of successful authentication (e.g., user name and password), or may require provision of otherwise unauthenticated user information (e.g., player name, player ID, team name, team ID, etc.). Players may be logged in individually or in a group. The user may be the player 72 or a third party (e.g., a coach, parent, or the like). If the user is already registered, login information may be provided and verified and/or authenticated, such as at the player information area 77. A user height associated with the player 72 profile may be retrieved, such as from one or more databases.

If the user is not already registered (e.g., a new user), registration information may be received, such as player 72 information (e.g., age, name, user ID, password, preferences, team affiliation, location information, gender, combinations thereof, or the like) and electronically stored, such as at one or more databases in electronic communication with the controller 68. The player 72 information may comprise height information. The height information may include height measurements, such as but not limited to standing height, chest height, seated height, combinations thereof, or the like, and/or indirect height measurements, such as but not limited to age and/or gender from which average height measurements corresponding to the same may be retrieved, such as from one or more databases in electronic communication with the controller 68. The height information may be electronically stored, such as at one or more databases in electronic communication with the controller 68 and in association with other information for the player 72, such as various player profile information. In exemplary embodiments, without limitation, the one or more databases may be provided at one or more electronic storage devices local or remote from the device 10, such as by way of the controller 68. The stored information may be updated periodically, such as at user demand.

In yet other exemplary embodiments, without limitation, player height may be automatically detected such as by way of one or more sensors 63. The sensors may comprise range finders, cameras and/or machine vision technology, ultrasonic sensors, combinations thereof, or the like.

User desired pass receipt locations and/or other information for initiating a practice routine with the device 10 may be received. In exemplary embodiments, without limitation, such information may be provided by way of the interface 50 and relayed to the controller 68.

The launching mechanism 28 may be adjusted based on the player 72 height information and/or the user desired practice routine information. For example, without limitation, the controller 68 may be configured to normally throw one of the basketballs 60 to a given one of the locations in a practice routine with a predetermined amount of speed, force, and/or velocity based on the distance and/or direction of the selected location relative to the device 10. The predetermined amount of speed, force, and/or velocity may be set based on an average height player 72. The average height may be any height, such as but not limited to a 6-foot-tall player with a corresponding approximate 4.5-foot chest height by way of non-limiting example. The default amount of speed, force, and/or velocity may be set to deliver the basketball 60 to the approximate 4.5-foot chest height at the selected location. If no height information is stored, retrieved, and/or determined, the controller 68 may be configured to operate with a default setting (e.g., default speed/force, such as equivalent to average male height, such as approximately 5' 10" by way of non-limiting example).

In exemplary embodiments, without limitation, the controller 68 may be configured automatically adjust the speed, force, and/or velocity of launching for the player 72 based on the player's 72 specified height information relative to the default. For example, without limitation, if the player 72 specifies a height below the 6-foot default, then the speed, force, and/or velocity of launch base be decreased. As another example, without limitation, if the player 72 specifies a height above the 6-foot default, then the speed, force, and/or velocity of launch base be increased. Such increase or decrease may be made in a proportional fashion, such as based on linear, percentage, logarithmic, polynomial, conical, or other extrapolation. Such increases or decreases may be in accordance with an electronically stored table of heights and speeds or forces of launch. In other exemplary embodiments, without limitation, no default standard may be provided and speed, force, and/or other characteristics of the launch may be based on one or more returned parameters for the player height.

Regardless, operation of the launching mechanism 28 may be adjusted based on player height. By way of non-limiting example, motor 84 and/or wheel 80 speed control may be adjusted as imparted to the basketballs 60. As another non-limiting example, one or more actuators 103 may be adjusted to adjust maximum spring 130 force provided to part of the launching device 28 and imparted to the basketballs 60. Any type or kind of adjustment may be made to any type or kind of launching mechanism 28.

Player 72 estimated chest height may be automatically determined based on inputted overall height, as players 72 or other users may not have ready access to chest height information. For example, without limitation, a predetermined amount may be subtracted from the player 72 height to arrive at an estimated chest height. The amount subtracted may be proportional to a user specified height, age, gender, combinations thereof, or the like. The speed or force of launch may be controlled based on estimated chest height, in exemplary embodiments without limitation.

Player 72 estimated overall and/or chest height may be automatically determined based on provided age and/or gender information, as players 72 or other users may not have ready access to height information. For example, without limitation, an average overall and/or chest height may be determined from player age and/or gender information provided, such as based on stored average.

Alternatively, or additionally, player heigh or chest height may be automatically determined, such as by way of the sensor(s) 63. In such embodiments, player login may not necessarily be required.

In exemplary embodiments, without limitation, the user may be permitted to update launching speed or force preferences by specifying an increase or decrease in launch speed or forces so that the player 72 receives the basketballs 60 at a higher or lower height. Such adjustments may be made by way of user preferences at the user interface 50 and electronically stored, by way of non-limiting example.

Any embodiment of the present invention may include any of the features of the other embodiments of the present invention. The exemplary embodiments herein disclosed are not intended to be exhaustive or to unnecessarily limit the scope of the invention. The exemplary embodiments were chosen and described in order to explain the principles of the present invention so that others skilled in the art may practice the invention. Having shown and described exemplary embodiments of the present invention, those skilled in the art will realize that many variations and modifications may be made to the described invention. Many of those variations and modifications will provide the same result and fall within the spirit of the claimed invention.

Certain operations described herein may be performed by one or more electronic devices. Each electronic device may comprise one or more processors, electronic storage devices, executable software instructions, combinations thereof, and the like configured to perform the operations described herein. The electronic devices may be general purpose computers or specialized computing devices. The electronic devices may comprise personal computers, smartphone, tablets, databases, servers, or the like. The electronic connections and transmissions described herein may be accomplished by wired or wireless means. The computerized hardware, software, components, systems, steps, methods, and/or processes described herein may serve to improve the speed of the computerized hardware, software, systems, steps, methods, and/or processes described herein. The electronic devices, including but not necessarily limited to the electronic storage devices, databases, controllers, or the like, may comprise and/or be configured to hold, solely non-transitory signals.

What is claimed is:

1. A basketball launching system which compensates for player height, said basketball launching system comprising:

a launching mechanism for launching basketballs; and a controller in electronic communication with a user interface and the launching mechanism, said controller comprising one or more non-transitory electronic storage devices comprising or in electronic communication with a database of player information, each associated with a respective one of a plurality of launch characteristics, and comprising software instructions, which when executed, configure one or more processors of the controller to:

query the database with respective player information received from, or generated in response to data received from, the user interface to return an associated one of the plurality of launch characteristics; and command the launching mechanism to launch the basketballs in accordance with the associated one of the plurality of launch characteristics such that the basketballs are launched with forces and/or speeds which varies, at least in part, based on the launch characteristics.

2. The basketball launching system of claim 1 wherein:

the plurality of launch characteristics each comprise a respective launch force.

3. The basketball launching system of claim 1 wherein:

the plurality of launch characteristics each comprise a respective launch speed.

4. The basketball launching system of claim 1 further comprising:

the user interface.

5. The basketball launching system of claim 4 further comprising:

a support structure;

a frame connected to the support structure;

support members extending from the frame;

a net supported by the support members; and a housing connected to the support structure and at least partially enclosing the launching mechanism, wherein the user interface, the launching mechanism, and the controller are structurally connected to the support structure.

6. The basketball launching system of claim 4 wherein:
the user interface is part of a remote electronic device in wireless electronic communication with the controller.

7. The basketball launching system of claim 6 wherein:
the database is provided at a second set of one or more non-transitory electronic storage devices in wireless electronic communication with the controller.

8. The basketball launching system of claim 4 wherein:
the one or more non-transitory electronic storage devices of the controller comprise additional software instructions, which when executed, configure the one or more processors of the controller to:
cause a player information prompt to be generated at the user interface; and
the respective player information is received in response to the player information prompt.

9. The basketball launching system of claim 8 wherein:
the player information comprises player heights; and
the player information prompt comprises at least one option for providing a respective player height.

10. The basketball launching system of claim 8 wherein:
the player information comprises login information; and
the player information prompt comprises at least one option for providing respective login information.

11. The basketball launching system of claim 10 wherein:
the login information comprises one or more of: a username, a password, a player ID, a team name, a team ID, biometric information, and a code.

12. The basketball launching system of claim 8 wherein:
the player information comprises player names; and
the player information prompt comprises option for providing a respective player name.

13. The basketball launching system of claim 8 wherein:
the player information comprises player heights; and
the player information prompt comprises at least one option for providing a respective player height.

14. The basketball launching system of claim 8 wherein:
the player information comprises player age and gender; and
the player information prompt comprises at least one option for providing a respective player age and gender.

15. The basketball launching system of claim 1 wherein:
the launching mechanism comprises at least one motorized tire; and
the plurality of launch characteristics comprise a power level for supply to the at least one motorized tire during operation of the launching mechanism.

16. The basketball launching system of claim 1 wherein:
the launching mechanism comprises a catapult comprising a catapult arm and a spring attached to the catapult arm; and
the plurality of launch characteristics comprises a position for the spring.

17. The basketball launching system of claim 1 wherein:
the launching mechanism comprises a strike arm and a spring connected to the strike arm; and
the plurality of launch characteristics comprises a position for the spring.

18. The basketball launching system of claim 1 wherein:
the one or more non-transitory electronic storage devices comprise additional software instructions, which when executed, configure the one or more processors to:
cause generation of one or more prompts at the user interface requesting user input for pass locations for a basketball practice session;
receive user input data from the user interface in response to the one or more prompts; and
cause the launching mechanism to launch the basketballs to the pass locations indicated in the user input data received from the user interface in response to the one or more prompts.

19. A method of compensating for player height during a basketball practice session using a basketball launching machine, said method comprising:
receiving, at a controller associated with the basketball launching machine and from a user interface in electronic communication with the controller, respective player information;
querying, by way of the controller, a database comprising launch characteristics and associated player information with the respective player information, or data indicating the respective player information, to return an associated one of the launch characteristics; and
commanding, by way of the controller, a launching mechanism of the basketball launching machine to operate in accordance with the respective launch characteristic, thereby causing the basketballs to be launched with forces and/or speeds which vary, at least in part, based on the launch characteristics.

20. A basketball launching machine which compensates for player height, said basketball launching machine comprising:
a support structure;
a frame structurally connected to the support structure;
support members extending from the frame;
a net supported by the support members;
a launching mechanism for launching basketballs supported by the support structure;
a housing structurally connected to the support structure and at least partially enclosing the launching mechanism;
a touch sensitive electronic user interface supported by the housing and/or the support structure; and
a controller in electronic communication with the user interface and the launching mechanism, said controller comprising one or more non-transitory electronic storage devices comprising a database of launch characteristics and associated player information, and software instructions, which when executed, configure one or more processors of the controller to:
receive respective player information from the user interface for a pass session;
query the database with the respective player information; and
command the launching mechanism to launch the basketballs for the pass session in accordance with an associated one of the launch characteristics corresponding to the respective player information thereby causing the basketballs to be launched with forces and/or speeds which vary, at least in part, based on the launch characteristics.

* * * * *